US007270595B2

(12) United States Patent
Elmufdi et al.

(10) Patent No.: US 7,270,595 B2
(45) Date of Patent: Sep. 18, 2007

(54) POLISHING PAD WITH OSCILLATING PATH GROOVE NETWORK

(75) Inventors: Carolina L. Elmufdi, Baltimore, MD (US); Ravichandra V. Palaparthi, Newark, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 212 days.

(21) Appl. No.: 10/855,537

(22) Filed: May 27, 2004

(65) Prior Publication Data

US 2005/0266776 A1 Dec. 1, 2005

(51) Int. Cl.
*B24B 1/00* (2006.01)

(52) U.S. Cl. ..... 451/36; 451/41; 451/59; 451/63; 451/527; 451/550

(58) Field of Classification Search ..... 451/36, 451/41, 59, 63, 527, 529, 550
See application file for complete search history.

(56) References Cited

U.S. PATENT DOCUMENTS 5,645,469 A 7/1997 Burke et al.
5,921,855 A 7/1999 Osterheld et al.
6,093,651 A 7/2000 Andideh et al.
6,120,366 A 9/2000 Lin et al.
6,159,088 A 12/2000 Nakajima et al.
6,165,904 A 12/2000 Kim et al.
6,241,596 B1 6/2001 Osterheld et al.
6,273,806 B1 8/2001 Bennett et al.
6,685,548 B2 * 2/2004 Chen et al. ..... 451/526
6,958,002 B1 * 10/2005 Palaparthi ..... 451/36
2001/0044263 A1 11/2001 Andideh et al.

FOREIGN PATENT DOCUMENTS

JP H08-011051 1/1996

* cited by examiner

*Primary Examiner*—Timothy V. Eley
(74) *Attorney, Agent, or Firm*—Blake T. Biederman

(57) ABSTRACT

A polishing pad (20) for polishing a wafer (32) or other article, the pad having a groove network (60) configured to increase the residence time polishing medium (46) on the pad. The groove network has a first portion (72) that may extend substantially radially outwardly and an oscillating portion (74) that begins at a transition point (76) and is configured to slow the radially outward flow of the polishing medium.

10 Claims, 4 Drawing Sheets

POLISHING PAD WITH OSCILLATING PATH GROOVE NETWORK

BACKGROUND OF THE INVENTION

The present invention generally relates to the field of chemical mechanical polishing. In particular, the present invention is directed to a chemical mechanical polishing pad having a groove network designed to control polishing medium residence time across the article being polished.

In the fabrication of integrated circuits and other electronic devices, multiple layers of conducting, semiconducting and dielectric materials are deposited onto and etched from a surface of a semiconductor wafer. Thin layers of conducting, semiconducting and dielectric materials may be deposited by a number of deposition techniques. Common deposition techniques in modem wafer processing include physical vapor deposition (PVD), also known as sputtering, chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the uppermost surface of the wafer becomes non-planar. Because subsequent semiconductor processing (e.g., photolithography) requires the wafer to have a flat surface, the wafer needs to be planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as semiconductor wafers. In conventional CMP using a dual-axis rotary polisher, a wafer carrier, or polishing head, is mounted on a carrier assembly. The polishing head holds the wafer and positions the wafer in contact with a polishing layer of a polishing pad within the polisher. The polishing pad has a diameter greater than twice the diameter of the wafer being planarized. During polishing, each of the polishing pad and wafer is rotated about its concentric center while the wafer is engaged with the polishing layer. The rotational axis of the wafer is generally offset relative to the rotational axis of the polishing pad by a distance greater than the radius of the wafer such that the rotation of the pad sweeps out a ring-shaped "wafer track" on the polishing layer of the pad. The radial distance between inner and outer boundaries of the wafer track defines the width of the wafer track. This width is typically equal to the diameter of the wafer when the only movement of the wafer is rotational. The carrier assembly provides a controllable pressure between the wafer and polishing pad. During polishing, a fresh polishing medium, e.g., slurry, is dispensed close to the rotational axis of the pad within the inner boundary of the wafer track. The polishing medium enters the wafer track from the inner boundary, flows into the gap between the wafer and the pad, contacts the wafer surface, and exits the wafer track at its outer boundary close to the edge of the pad. This movement of the polishing medium occurs in a substantially radially outwardly direction due to the centrifugal force induced on the polishing medium as a consequence of rotation of the pad. The wafer surface is polished and made planar by chemical and mechanical action of the polishing layer and polishing medium on the surface.

In a typical CMP process involving the use of reactants in the polishing medium, when the polishing medium contacts the wafer surface within the wafer track of the pad, the reactants interact with features on the wafer being polished, e.g., copper metallurgy, thereby forming reaction products. As the dispensed polishing medium flows from the inner boundary to the outer boundary of the wafer track, the amount of time the polishing medium is exposed to the wafer surface (residence time) increases. Interaction of the polishing medium with the wafer material causes a variation in relative proportions of the reactants and reaction products in the polishing medium, as measured along a radius of the pad. The polishing medium near the inner boundary of the wafer track has a relatively high proportion of reactants (much like fresh polishing medium), and the polishing medium near the outer boundary of the wafer track has a relatively low proportion of reactants and a relatively high proportion of reaction products (much like spent polishing medium).

Polishing at any given location on the wafer is influenced by the relative proportions of reactants and reaction products. An increase in the relative amount of reaction product at a given location will typically either increase or decrease the polishing rate at that location, all other factors being equal. To achieve the polishing rates across the entire wafer necessary to obtain a planar surface, it is not enough to merely control the quantity of polishing medium available to the wafer at a given radial location. Instead the wafer should be uniformly exposed to polishing medium containing different concentration levels of reactants and the reaction products. Unfortunately, known CMP systems and associated polishing pads do not typically distribute polishing medium in a manner that ensures appropriate residence time for the reaction products.

It is known to provide outwardly extending grooves in a polishing pad that have one or both of an increasing width and decreasing depth so as to slow the radial flow rate of slurry applied to the pad. Such a groove pattern is described in U.S. Pat. No. 5,645,469 to Burke et al. While the groove pattern described in the '469 patent may slow the radial flow rate of slurry to some extent, it does so using straight, radially extending grooves.

STATEMENT OF THE INVENTION

In one aspect of the invention, a polishing pad for polishing an article, the polishing pad comprising a polishing layer having rotational axis and a plurality of grooves, each groove of the plurality of grooves including (a) a first portion extending outwardly with respect to the rotational axis and (b) an oscillating portion in communication with the first portion at a transition location.

In another aspect of the invention, a method of polishing an article using a polishing pad having a rotational axis and a polishing medium, the method comprising the steps of:

a. providing a pad having grooves that extend outwardly from the rotational axis;

b. engaging the pad with a surface of the article;

c. effecting relative rotation between the pad and the article so that a track of the pad contacts the article; and d. causing the polishing medium to flow between the pad and the surface of the article within the grooves in a manner such that the polishing medium has a first residence time until reaching a transition point at which the residence time increases as a step function to a second residence time, wherein the polishing medium is caused to flow along an oscillating path after reaching the transition point.

In yet another aspect of the invention, a polishing pad for polishing an article, the polishing pad comprising:

a polishing portion having a rotational axis and a plurality of grooves, each groove of the plurality of grooves including:

a. first portion extending outwardly with respect to the rotational axis;

b. a second portion having a major axis that extends outwardly with respect to the rotational axis, the second portion in communication with the first portion at a transition location and configured to slow outward flow of polishing medium by causing the polishing medium to follow an oscillating path.

DETAILED DESCRIPTION OF THE INVENTION

Figure 1:
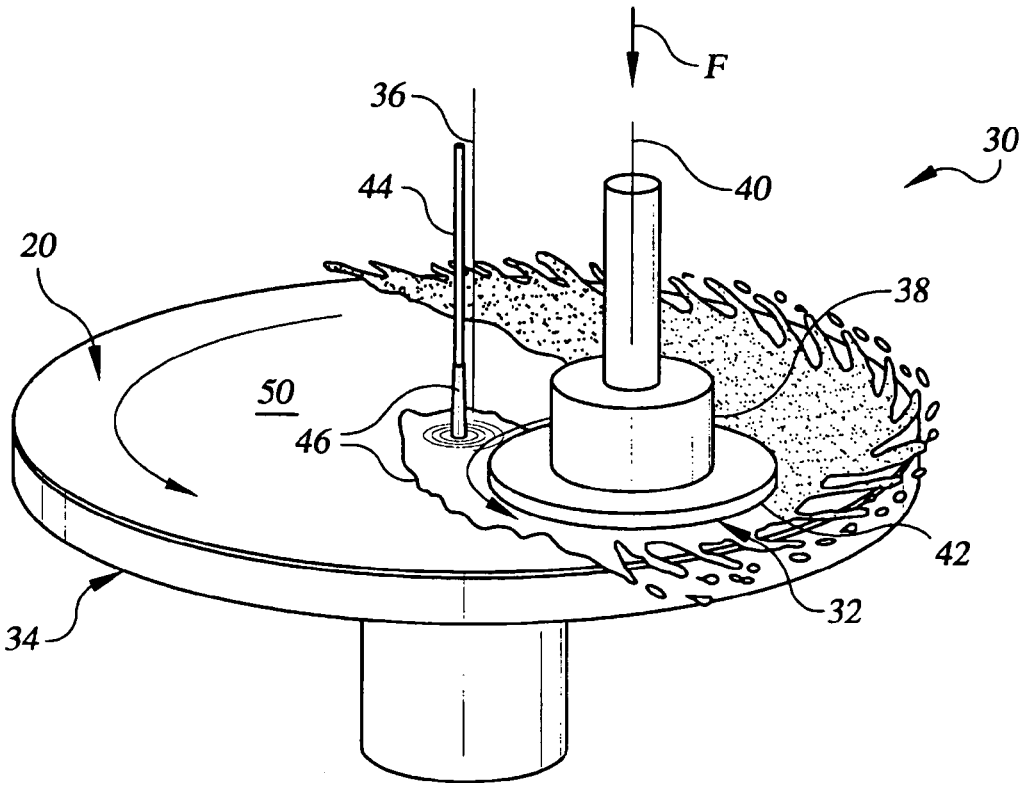
FIG. 1 is a perspective view of a portion of a dual-axis polisher suitable for use with the present invention.

Referring to FIG. 1, the present invention is a polishing pad 20 usable with a chemical mechanical polishing (CMP) polisher 30 for planarizing a wafer 32 or other workpiece. References to wafer 32 are intended to include other workpieces as well, except when the context of use clearly indicates otherwise. As described below, polishing pad 20 is designed to optimize residence time of polishing medium used in a CMP process so as to enhance uniformity of planarization of wafer 32. As used herein, the term "polishing medium" is used in its broadest sense, and includes without limitation any slurry or other material used in connection with the planarization of articles with a CMP polisher. The term "polishing medium" may include fresh polishing medium in the form initially introduced to the CMP polisher and polishing medium having a composition that has changed over time as a consequence of the polishing process. Such changes may include, for instance, an increase in reaction products and a decrease in reactants, or modifications in attributes of abrasives, included in the polishing medium.

Before describing polishing pad 20 in detail, a brief description of polisher 30 is provided. Polisher 30 may include a platen 34 on which polishing pad 20 is mounted. Platen 34 is rotatable about a rotational axis 36 by a platen driver (not shown). Wafer 32 may be supported by a wafer carrier 38 that is rotatable about a rotational axis 40 parallel to, and spaced from, rotational axis 36 of platen 34. Wafer carrier 38 may feature a gimbaled linkage (not shown) that allows wafer 32 to assume an aspect very slightly non-parallel to polishing pad 20, in which case rotational axes 36 and 40 may be very slightly askew. Wafer 32 includes polished surface 42 that faces polishing pad 20 and is planarized during polishing. Wafer carrier 38 may be supported by a carrier support assembly (not shown) adapted to rotate wafer 32 and provide a downward force F to press polished surface 42 against polishing pad 20 so that a desired pressure exists between the polished surface and the polishing pad during polishing. Polisher 30 may also include a polishing medium inlet 44 for supplying polishing medium 46 to polishing pad 20. Polishing medium 44 should generally be positioned at or close to rotational axis 36 to optimize the effectiveness of polishing pad 20, although such placement is not a requirement for operation of the polishing pad.

As those skilled in the art will appreciate, polisher 30 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 32 and polishing pad 20; (2) controllers and selectors for varying the rate and location of delivery of polishing medium 46 to the pad; (3) controllers and selectors for controlling the magnitude of force F applied between the wafer and pad, and (4) controllers, actuators and selectors for controlling the location of rotational axis 40 of the wafer relative to rotational axis 36 of the pad, among others. Those skilled in the art will understand how these components are constructed and implemented such that a detailed explanation of them is not necessary for those skilled in the art to understand and practice the present invention. While polishing pad 20 works effectively with a polisher such as polisher 30 described above, the pad may also be used with other polishers.

During polishing, polishing pad 20 and wafer 32 are rotated about their respective rotational axes 36 and 40, and polishing medium 46 is dispensed from polishing medium inlet 44 onto the rotating polishing pad. Polishing medium 46 spreads out over polishing pad 20, including into the gap beneath wafer 32 and the polishing pad. Polishing pad 20 and wafer 32 are typically, but not necessarily, rotated at selected speeds between 0.1 rpm to 150 rpm. Force F is typically, but not necessarily, of a magnitude selected to induce a desired pressure of 0.1 psi to 15 psi (0.7 to 103 kPa) between wafer 32 and polishing pad 20.

Polishing pad 20 has a polishing layer 50 for engaging an article, such as semiconductor wafer 32 (processed or unprocessed) or other workpiece, e.g., glass, flat panel display or magnetic information storage disk, among others, so as to effect polishing of the polished surface of the workpiece in the presence of a polishing medium 46 or other polishing medium. For the sake of convenience, the terms "wafer" and "polishing medium" are used below without the loss of generality.

Figure 2:
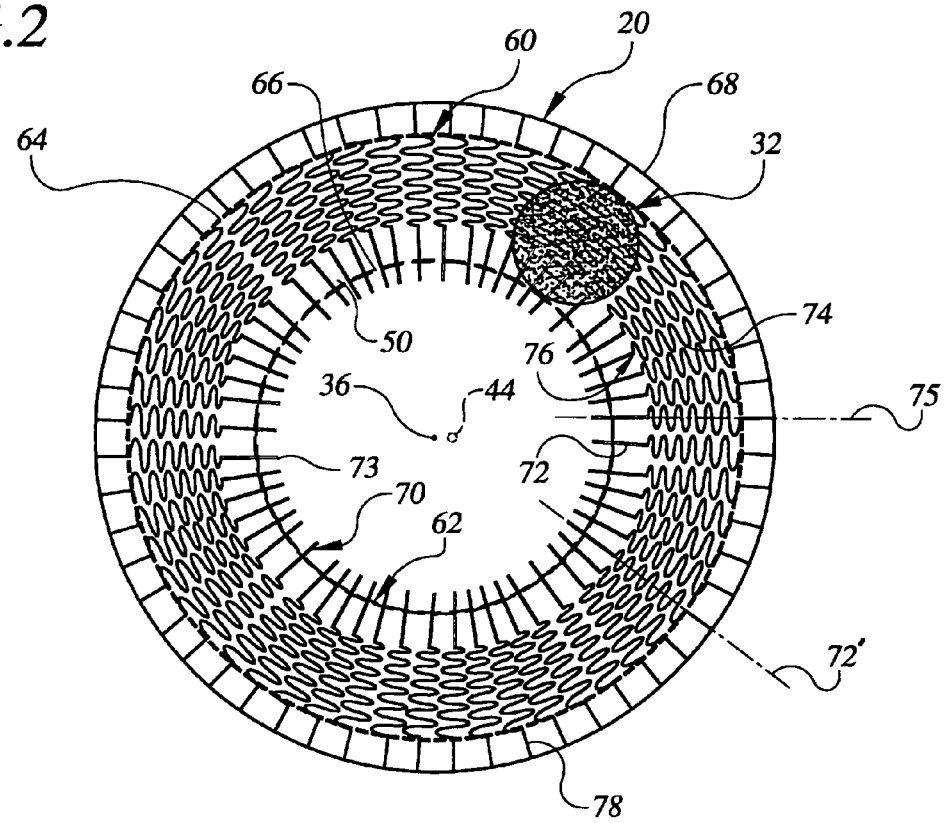
FIG. 2 is a top view of the one embodiment of the polishing pad of the present invention, with the outline of a wafer to be polished shown in phantom view.
Figure 3:
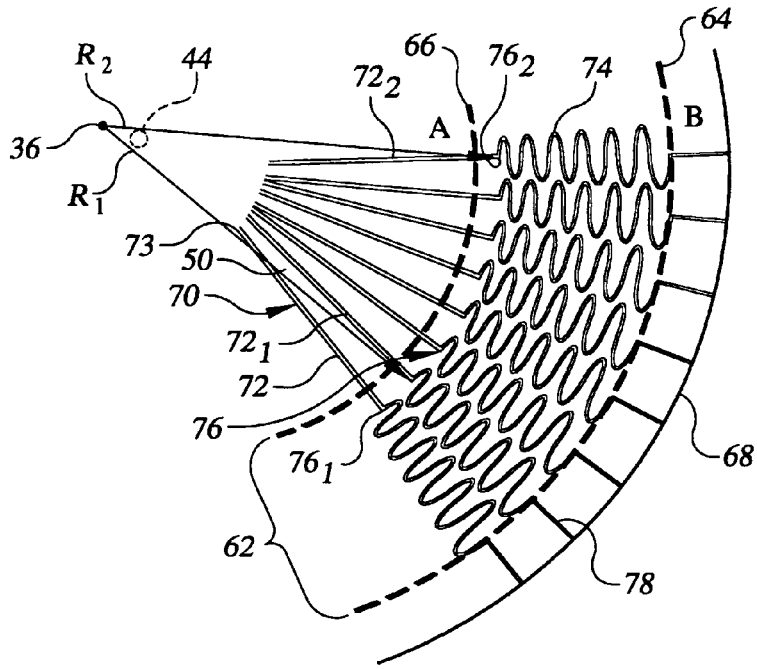
FIG. 3 is an enlarged top view of a section of the pad shown in FIG. 2.

Turning now to FIGS. 1-3, polishing pad 20 includes a groove network 60 designed to increase residence time within the groove network of reaction products formed by the interaction of reactants in polishing medium 46 with portions of wafer 32 being polished. Polishing pad 20 includes a wafer track 62 defined by an imaginary radially outer circle 64 and an imaginary radially inner circle 66. Wafer track 62 is the portion of polishing pad 20 that actually polishes wafer 32. Outer circle 64 is typically positioned radially inwardly of periphery 68 of polishing pad 20 and inner circle 66 is typically positioned radially outwardly of rotational axis 36 of the polishing pad.

Groove, network 60 includes a plurality of grooves 70 that aid in the transport of polishing medium 46 radially outwardly toward periphery 68 of polishing pad 20. Grooves 70 include a first portion 72 having a major axis 72' that extends substantially radially outwardly from rotational axis 36. For the purposes of this specification, major axis 72' represents the center line of groove 70 as it extends from a location near rotational axis 36 to periphery 68. As used herein, "substantially radially" includes divergence from a perfectly radial direction of up to 30 degrees. First portion 72 typically has a straight configuration along its major axis. The width and depth of grooves 70 in first portion 72 will vary depending upon desired polishing performance, number of grooves 70 provided, desired polishing medium residence time and other factors. In an exemplary embodiment of polishing pad 20, grooves 70 in first portion 72 have a width in the range of 5-50 mils (0.127-1.27 rmn) and a depth in the range of 10 to 50 rolls (0.254-1.27 mm).

First portion 72 is generally formed so that its radially inner end 73 (FIG. 3) is positioned radially inwardly of inner circle 66 and is positioned relatively close to rotational axis 36. The exact placement of inner end 73 will be influenced by the location of polishing medium inlet 44, with it generally being desirable to locate inner end 73 so that it will be radially outward of the polishing medium inlet. This relative placement is not required, however, and those skilled in the art will empirically determine the optimal relative placement of inner end 73 with respect to polishing medium inlet 44. In FIG. 3, a suitable location for polishing medium inlet 44 is depicted in phantom view. This location should be viewed as representative and not limiting.

Grooves 70 also include an oscillating portion 74 that is positioned radially outwardly of first portion 72. First portion 72 is connected to oscillating portion 74 at transition point 76, and is in fluid communication with the oscillating portion. As illustrated in FIGS. 2 and 3, oscillating portion 74 has a sinusoidal configuration, the amplitude of which may increase moving outwardly from rotational axis 36. As an alternative or additional feature, oscillating portion 74 may be designed so its sinusoidal configuration has an increasing frequency, moving outwardly from rotational axis 36. For the purposes of this specification the frequency represents the cycles per unit distance along major axis 72' of groove 70. This is inversely proportional to the wavelength of oscillating portion 74, which is the distance along major axis 72' over which one cycle of oscillating portion 74 extends. While not preferred in many applications, in some cases it may be appropriate to design sections of oscillating portion 74 of one or more grooves 70 so that one or both of the amplitude and frequency changes, moving radially outwardly from rotational axis 36. For example, the amplitude, frequency and combination of amplitude and frequency may decrease or increase with respect to a direction moving outwardly from rotational axis 36. The change in amplitude and frequency of oscillating portion 74 is generally linear, although the present invention encompasses step functions and other non-linear changes. The wavelength of oscillating portion 74 is typically less, and often substantially less, than the radius of polishing pad 20, as measured between rotational axis 36 and periphery 68, Optionally, polishing pad 20 may include grooves that do not include an oscillating portion 74 in combination with the grooves 70.

In an exemplary embodiment a pad 20, oscillating portion 74 has an amplitude that increases from 0.1-2.0" (2.54-50 mm), as measured between transition point 76 and the radially outermost portion of the oscillating portion. The frequency of oscillating portion 74 in this embodiment increases from 0.1-1 cycles per cm, as measured along major axis 72' of groove 72 between transition point 76 and the radially outermost portion of the oscillating portion. The amplitude and frequency are dependent on the dimensions (width and depth) of groove 70.

For many applications, grooves 70 have a smoothly curved configuration at the peak and trough sections of the sinusoid defining oscillating portion 74, as illustrated in FIGS. 2 and 3. In some applications, however, a sharp transition may be provided at the peak and trough sections such that oscillating portion 74 has a zig-zag configuration.

Oscillating portion 74 has a major axis 75 that extends outwardly from rotational axis 36. Major axis 75 may extend substantially radially outwardly from rotational axis 36. As used herein, "substantially radially" includes divergence of major axis 75 from a perfectly radial direction of up to 30 degrees. Typically, major axis 75 of second portion 74 has a substantially straight configuration, although the major axis of oscillating portion may also have a curved configuration Grooves 70 in oscillating portion 74 may have a constant width, as illustrated in FIGS. 2 and 3. The invention is not so limited, however. Grooves 70 may have a width that changes over the length of the grooves. Further, residence time may be influenced by modifying the depth of grooves 70 in oscillating portion 74. In an exemplary embodiment of the invention, grooves in second portion 74 have a uniform width, at the point of greatest width, of 70-100 mils (1.78-2.54 mm). In many applications, it will be desirable to increase the width of grooves 70 progressively from the width at transition point 76 to the point of greatest width. The point of greatest width for grooves 70 is typically at outer circle 64 and the width may, if desired, decrease as the grooves continue radially outwardly toward peripheral edge 68.

Oscillating portions 74 may extend radially outwardly to periphery 68, to outer circle 64 or to a point radially inwardly of the outer circle 64. The desired residence time for polishing medium 46 will be a primary influence on where oscillating portions 74 terminate, although other design and operational criteria may also influence such placement.

When oscillating portions 74 terminate radially inward of periphery 68, it may be desirable to provide peripheral portions 78 in fluid communication with oscillating portions 74. Peripheral portions 78 lack the oscillating path configuration of oscillating portions 74. Peripheral portions 78 may extend straight radially outwardly toward periphery 68 relative to rotational axis 36, may be straight but extend outwardly at an angle relative to radii extending out from rotational axis 36 or may extend in a curved manner outwardly toward the periphery. While often desirable, peripheral portions 78 are an optional feature of groove network 60.

The radial distance that transition points 76 of grooves 70 are spaced from rotational axis 36 will often be the same for all of the grooves. For example, with reference to FIG. 3, transition point $\mathbf{76}_1$ of first portion $\mathbf{72}_1$ is positioned a radial distance $R_1$ from rotational axis 36 that is equal to the radial distance $R_2$ transition point 762 of first portion $\mathbf{72}_2$ is spaced from rotational axis 36. Manufacturing variation may result in a slight difference in the distance transition points 76 are spaced from rotational axis 36. In addition, in some cases, it may be desirable to vary placement of transition points 76 of some grooves 70. Typically, transition points 76 are positioned radially outwardly of inner circle 66, although in some cases it may be desirable to position the transition points 76 radially inwardly of inner circle 66. In general, transition points 76 are spaced from the rotational axis 36 a distance equal to 5-50% of the distance between rotational axis 36 and rotational axis 40 of wafer 32

With continuing reference to FIGS. 1-3, the use and operation of polishing pad 20 is now discussed. As noted above, polishing pad 20 is adapted for use with polishing medium 46 having abrasives, reactants, and after some use, reaction products. Polishing medium 46 is introduced proximate rotational axis 36, e.g., via polishing medium inlet 44, and then travels radially outwardly due to the centrifugal force imparted to the polishing medium by the rotation of polishing pad 20. Polishing medium 46 travels radially outwardly principally in first portions 72 of grooves 70, although some small amount of polishing medium may be transported outwardly in the regions between the grooves.

As polishing medium 46 contacts wafer 32, reactants in the polishing medium interact with features on the wafer, e.g., copper metallurgy, thereby forming reaction products. Depending upon the chemistry of polishing medium 46, the composition of features in wafer 32 with which the reactants interact, and other factors, such reaction products may decrease or increase polishing rates. Oscillating portion 74 slows the radially outward movement of polishing medium 46 relative to the movement of such polishing medium in first portion 72 by causing the polishing medium to travel along an oscillating path. This change in path of polishing medium 46 will generally occur rapidly, i.e., as a step function, at transition point 76. In other words, the residence time of polishing medium 46 will typically increase immediately as the polishing medium moves radially outwardly of transition point 76. If a slower transition is desired for certain applications, however, this can be readily accommodated by configuring the sections of oscillating portion 74 near transition point 76 to have a very gentle curvature that increases in amplitude and frequency when moving outwardly from rotational axis 36.

By increasing the residence time of polishing medium 46 at any given location along radii intersecting oscillating portion 74, the reactants and reaction products in polishing medium 46 are exposed to wafer 32 longer than would typically be the case for groove patterns known in the prior art. Groove configurations in known polishing pads do not typically slow the radially outward movement by causing the polishing medium to flow along an oscillating path. Because of the aforementioned influence that the reaction products have on polishing rates, it tends to be difficult to achieve uniform planarization of the wafer being polished when using polishing medium compositions that result in the formation of reaction products.

In determining the optimum configuration for oscillating portion 74, the best placement for transition points 76, the optional combination of supplemental non-oscillating grooves with grooves 70 having oscillating portions 74, and other aspects of the design of polishing pad 20, a design objective is to provide a residence time distribution for polishing medium 46 across the entire wafer track 62 that maximizes the planarity of wafer 32. As those skilled in the art are aware, this design objective can be obtained through evaluation of the chemistry of polishing medium 46 and its interaction with wafer 32, consideration and analysis of materials included in the wafer, computer modeling of pad 20 and empirically through the use of prototype pads having different design attributes, as discussed above.

Figure 4:
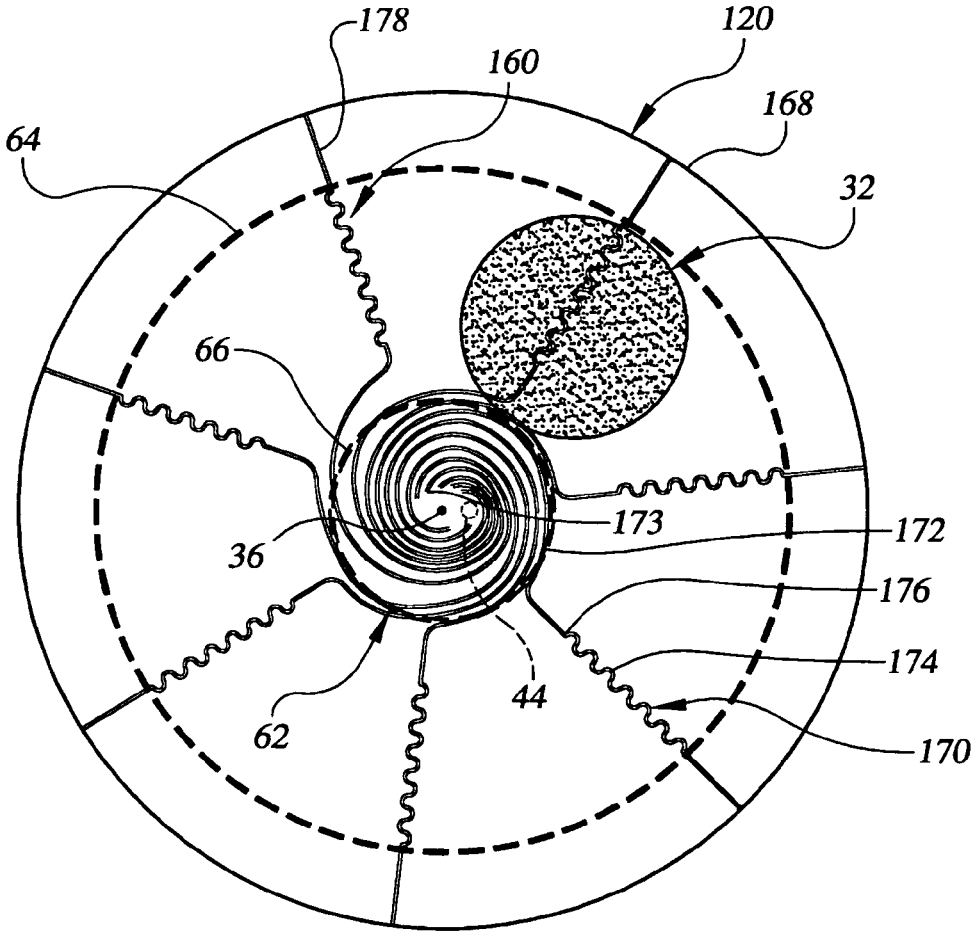
FIG. 4 is a top view of another embodiment of the polishing pad of the present invention, with the outline of a wafer to be polished shown in phantom view.

Turning next to FIGS. 1 and 4, in another embodiment of the present invention a polishing pad 120 having an alternative groove network 160 is provided. Groove network 160 includes a plurality of grooves 170, each having a first portion 172, an oscillating portion 174, and a transition point 176 where the first portion 172 joins the oscillating portion 174. First portion 172 of groove 170 is in fluid communication with the oscillating portion 174 of the groove.

First portion 172, unlike first portion 72, does not extend radially outwardly from rotational axis 36. Instead, first portion 172 has a curved configuration that may begin at or near its inner end 173. As illustrated in FIG. 4, first portion 172 may be wrapped in a spiral configuration about rotational axis 36 within inner circle 66 and retains its curved configuration after passing into wafer track 62. The extent of curvature of first portion 172 illustrated in FIG. 4 is merely exemplary, and is not intended to limit the configuration the first portion may assume. In this regard, first portion 172 may deviate only slightly from a perfectly radial extension out from rotational axis 36, may have a somewhat more aggressive curvature (e.g., by providing a smaller radius of curvature and/or greater length), or may be heavily curved as illustrated in FIG. 4. Further, first portion 172 may have a non-curved portion between inner end 173 and transition point 176.

Oscillating portions 174 are identical to oscillating portions 74, as described above. In this regard, oscillating portions 174 may have a straight configuration and extend radially outwardly along its major axis with respect to rotational axis 36, or may deviate from a perfectly radial relationship by up to 30 degrees. Oscillating portions 174 will often extend outwardly past outer circle 64 and terminate near or at periphery 168, but the invention encompasses termination of the oscillating portions within outer circle 64. In some cases, it may be desirable to provide peripheral portions 178 at the radially outer ends of grooves 170. Peripheral portions 178 may be identical to peripheral portions 78, discussed above.

As described above, transition points 176 typically, but not necessarily, are equally spaced radially from rotational axis 36. This configuration is identical to the relative placement of transition points 76 of grooves 70, as described above, and so the invention encompasses manufacturing deviation from such equal spacing as well as intentional design variation, as discussed above relative to grooves 70. As with grooves 70, grooves 170 are typically positioned as densely as possible on polishing pad 160, although this placement of the grooves is not mandatory. In this regard, it is to be appreciated that groove network 160 will be more densely populated with grooves 170 than is illustrated in FIG. 4. For many applications, it will be desirable to place transition points 176 relatively close to inner circle 66, as illustrated in FIG. 4. Placement of transition points 176, however, should be strongly influenced by empirical examination of how differing placement of transition points 176 influences polishing of wafer 32.

In operation, grooves 170 of polishing pad 120 control the residence time of reaction products in polishing medium 46 carried in the grooves in substantially the same manner as grooves 70, as described above. In particular, oscillating portions 174 slow the radially outward flow of polishing medium 46 by causing the polishing medium to flow along an oscillating path. As described above relative to grooves 70, the precise configuration of grooves 170 will typically be influenced by the chemistry of polishing medium 46, the composition of wafer 32, and other factors known to those skilled in the art.

Figure 5:
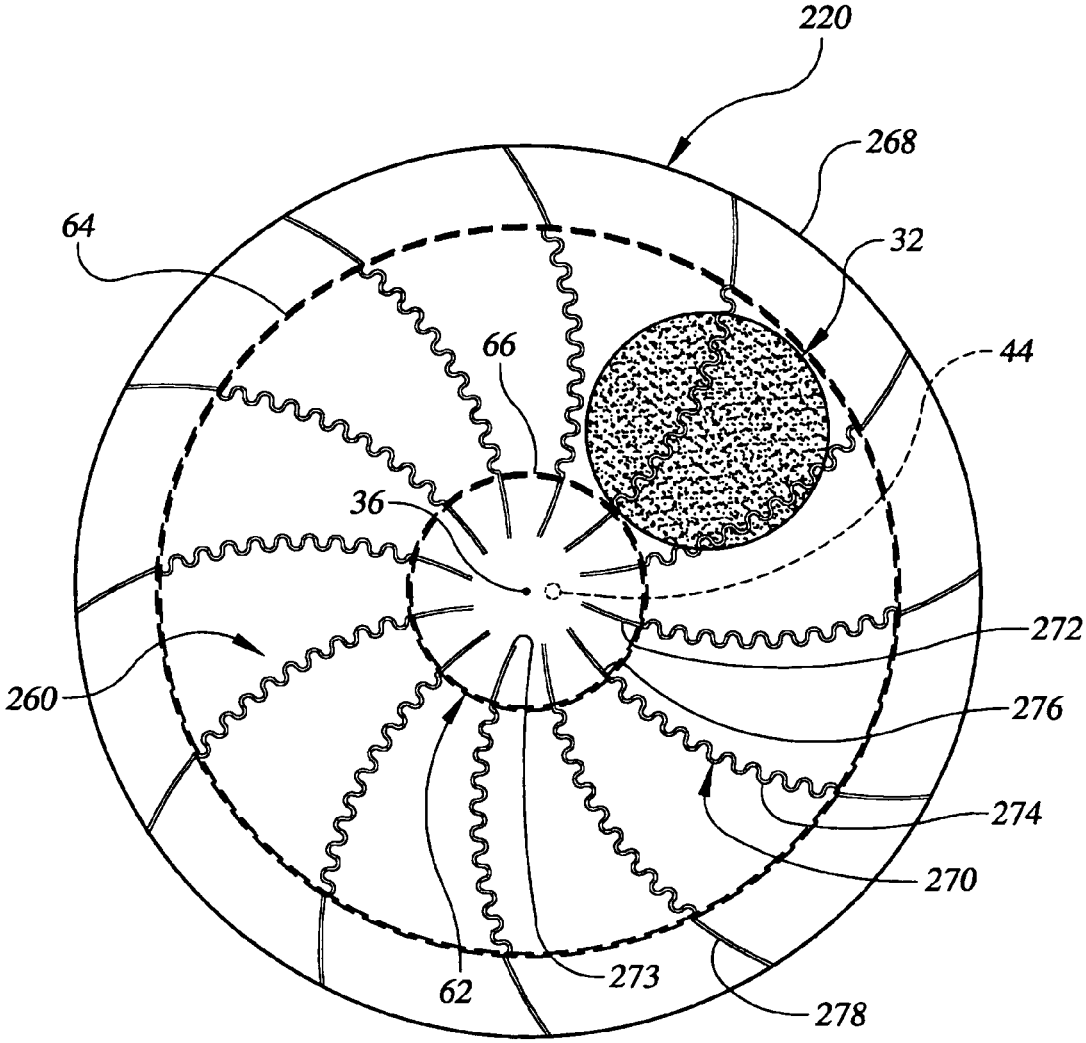
FIG. 5 is a top view of yet another embodiment of the polishing pad of the present invention, with the outline of a wafer to be polished shown in phantom view.

Referring now to FIGS. 1 and 5, in yet another embodiment of the present invention a polishing pad 220 having an alternative groove network 260 is provided. Groove network 260 includes a plurality of grooves 270, each having a first portion 272 that is similar to first portion 72, as described above, except that it is curved along most, if not all, of its major axis. Each groove 270 also includes an oscillating portion 274 that is similar to oscillating portion 74, except that it is curved. This curvature may extend along some or all of the major axis of oscillating portion 274. First portion 272 of groove 270 is in fluid communication with oscillating portion 274 of the groove, and joins the second portion at transition point 276. Optionally, groove 270 may include peripheral portion 278, which may be identical to peripheral portion 78, described above. As with grooves 70, grooves 270 are typically positioned as densely as possible on polishing pad 260, although the present invention encompasses less than maximally dense placement of the grooves.

In operation, grooves 270 of polishing pad 220 control the residence time of reaction products in polishing medium 46 carried in the grooves in substantially the same manner as grooves 70, as described above. As described above relative to grooves 70, the precise configuration of grooves 270 will typically be influenced by the chemistry of polishing medium 46, the composition of wafer 32, and other factors known to those skilled in the art.

The invention claimed is:

1. A method of polishing a wafer using a polishing pad having a rotational axis and a polishing medium, the method comprising the steps of:

a. providing a pad having a plurality of grooves, each groove having a major axis extending outwardly from near the rotational axis to a periphery of the polishing pad, the major axis representing the center line of each groove, and the plurality of grooves including: a first portion that extends outwardly from near the rotational axis in a straight or curved configuration along the major axis; and a second portion that extends outwardly with respect to the rotational axis, the second portion in communication with the first portion at a transition location within a wafer track and configured to slow outward flow of polishing medium by causing the polishing medium to follow an oscillating path having a frequency and an amplitude along the major axis, the transition location transitioning the straight or curved configuration of the first portion to the frequency and amplitude of the oscillating portion;

b. engaging the pad with a surface of the article;

c. effecting relative rotation between the pad and the article so that a track of the pad contacts the article; and d. causing the polishing medium to flow between the pad and the surface of the article within the plurality of grooves in a manner such that the polishing medium has a first residence time in the first portion until reaching a transition point within a wafer track at which the residence time increases as a step function to a second residence time in the second portion, wherein the polishing medium is caused to flow along an oscillating path after reaching the transition point.

2. A method according to claim 1, wherein the second residence time is greater than the first residence time.

3. A polishing pad for polishing a wafer, the polishing pad comprising:

a. a polishing portion having a rotational axis, a wafer track and a plurality of grooves, each groove having a major axis extending outwardly from near the rotational axis to a periphery of the polishing pad, the major axis representing the center line of each groove, and the plurality of grooves including:

i. a first portion extending outwardly from near the rotational axis in a straight or curved configuration along the major axis; and ii. an oscillating portion in communication with the first portion at a transition location, the oscillating portion extending outwardly from the rotational axis and having a frequency and an amplitude along the major axis for increasing residence time of a polishing medium and the transition location being within the wafer track and transitioning the straight or curved configuration of the first portion to the frequency and amplitude of the oscillating portion.

4. The pad according to claim 1, wherein the transition locations of the plurality of grooves are equally spaced from the rotational axis.

5. The pad according to claim 1, wherein the first portion has a spiral configuration.

6. The pad according to claim 1, wherein the oscillating portion has a sinusoidal configuration and one or both of the frequency and amplitude change as measured along a radius extending outwardly from the rotational axis and intersecting the oscillating portion.

7. The pad according to claim 1, wherein the oscillating portion has a major axis that extends radially with respect to the rotational axis.

8. The pad according to claim 1, wherein at least a section of the oscillating portion has a major axis with a curved configuration.

9. A polishing pad for polishing a wafer, the polishing pad comprising:

a. a polishing portion having a rotational axis and a plurality of grooves, each groove having a major axis extending outwardly from near the rotational axis to a periphery of the polishing pad, the major axis representing the center line of each groove, and the plurality of grooves including:

i. a first portion extending outwardly from near the rotational axis in a straight or curved configuration along the major axis; and ii. a second portion that extends outwardly with respect to the rotational axis, the second portion in communication with the first portion at a transition location within a wafer track and configured to slow outward flow of polishing medium by causing the polishing medium to follow an oscillating path, the oscillating path having a frequency and an amplitude along the major axis and the transition location transitioning the straight or curved configuration of the first portion to the frequency and amplitude of the oscillating portion.

10. The pad according to claim 9, wherein said second portion has at least one of a width that increases and a depth that decreases at said transition location.

* * * * *